US005181762A

United States Patent [19]

Beumer

[11] Patent Number: 5,181,762

[45] Date of Patent: Jan. 26, 1993

[54] BIOMECHANICAL BODY SUPPORT WITH TILTING LEG REST TILTING SEAT AND TILTING AND LOWERING BACKREST

[75] Inventor: Anton H. Beumer, Silvolde, Netherlands

[73] Assignee: Revab B.V., Silvolde, Netherlands

[21] Appl. No.: 693,360

[22] Filed: Apr. 30, 1991

[30] Foreign Application Priority Data

May 2, 1990 [NL] Netherlands ..... 9001053

[51] Int. Cl.[5] ..... A47C 1/02; A47C 1/06; A47C 1/12

[52] U.S. Cl. ..... 297/358; 297/DIG. 4; 297/330

[58] Field of Search ..... 297/354–358, 297/DIG. 4, 84, 87, 316, 317, 318, 323, 330, 343

[56] References Cited

U.S. PATENT DOCUMENTS

| | | | |
|---|---|---|---|
| 2,558,171 | 6/1951 | Chesley . | |
| 2,864,431 | 12/1958 | Eaton | 297/330 |
| 3,172,699 | 3/1965 | Naughton | 297/330 |
| 3,618,968 | 11/1971 | Greer | 297/DIG. 4 X |
| 3,934,929 | 1/1976 | Rabinowitz . | |
| 3,936,893 | 2/1976 | Anderson et al. | 297/DIG. 4 X |
| 4,339,013 | 7/1982 | Weigt | 297/354 X |
| 4,386,803 | 6/1983 | Gilderbloom | 297/330 X |
| 4,655,471 | 4/1987 | Peek | 297/358 X |

FOREIGN PATENT DOCUMENTS

| | | | |
|---|---|---|---|
| 1957744 | 6/1970 | Fed. Rep. of Germany . | |
| 2524568 | 12/1976 | Fed. Rep. of Germany . | |
| 2628033 | 12/1977 | Fed. Rep. of Germany . | |
| WO79/00647 | 9/1979 | PCT Int'l Appl. . | |
| 2157557 | 10/1985 | United Kingdom | 297/356 |

*Primary Examiner*—Kenneth J. Dorner
*Assistant Examiner*—James M. Gardner
*Attorney, Agent, or Firm*—Hoffmann & Baron

[57] ABSTRACT

The apparatus is a biomechanical body support including a substructure, a seat which is supported by said substructure and is tiltable relative to said substructure, a backrest which is coupled to said seat and is tiltable relative to said seat, the tilting axis of the backrest approximately coinciding with the pivotal point of the hip joint of a person resting on said seat, as well as a leg support also tiltably connected to said seat. According to the invention the backrest (14) is slidably mounted on a reversed U-shaped tilting frame (6) arranged behind the backrest, the fixed leg of said frame, which is directed towards the backrest, being hingedly connected to a first point (A) of the seat (15) while the second leg (12) is length-adjustable and is connected to a second point (B) of the seat, the backrest (14) being connected to the seat (15) by an adjusting mechanism (7), the arrangement being such that upon downward pivoting movement of the tilting frame (6) the backrest (14) slides relative to the tilting frame (6) in the direction of the seat (15).

16 Claims, 6 Drawing Sheets

BIOMECHANICAL BODY SUPPORT WITH TILTING LEG REST TILTING SEAT AND TILTING AND LOWERING BACKREST

This invention relates to a biomechanical body support comprising a substructure, a seat which is supported by said substructure and is tiltable relative to said substructure, a backrest which is coupled to said seat and is tiltable relative to said seat, the tilting axis of the backrest approximately coinciding with the pivotal point of the hip joint of a person resting on said seat, as well as a leg support also tiltably connected to said seat.

Such an apparatus is known from U.S. Pat. No. 3,934,929, in which a dentist's chair is described in which the backrest, the seat and the leg support are coupled with each other in such a way that these parts cannot be independently adjusted to a different position. Tilting the seat necessarily results in a change of the angle formed by backrest and seat and by seat and leg support. Tilting the backrest relative to the seat occurs about a concrete tilting axis, which approximately coincides with the pivotal point of the hip joint of a person sitting on the seat. Although this offers the advantage that the backrest when tilted does not move or shift relative to the back of the patient sitting in the chair, it renders the chair less accessible because it does not permit a person to sit down in the chair from the side and to subsequently turn his body 90° and to arrange his legs on the leg support and his back against the backrest.

It is an object of the invention to provide a chair for disabled people, which may or may not be mobile, in which the backrest and the leg support are adjustable independently of the position of the seat and tiltable together with the seat while their relative angular position is maintained and the lateral accessibility of the chair is optimal.

To that effect, the chair for disabled people according to the invention is characterized in that the backrest is slidably mounted on a reversed U-shaped tilting frame arranged behind the backrest, the fixed leg of said frame, which is directed towards the backrest, being hingedly connected to a first point of the seat while the second leg is length-adjustable and is connected to a second point of the seat, the backrest being connected to the seat by means of an adjusting mechanism, the arrangement being such that upon downward pivoting movement of the tilting frame the backrest slides relative to the tilting frame in the direction of the seat.

In this way a chair for disabled people is obtained, in which the backrest can be brought into a horizontal position while the seat is in stationary position. Although the real pivoting or tilting point of the backrest has been moved to a point on the rear edge of the seat, by virtue of a displacement of the backrest occurring during tilting of the backrest, a virtual tilting point has been obtained at the hip joint of the disabled person. By arranging the tilting frame of the backrest behind the backrest, the lateral accessibility of the chair is optimal.

It is observed that from DE-A- 1.957.744 it is known per se for the backrest of a dentist's chair or similar chair to be slidably mounted on a tilting frame which hinges on a hinge pin located at the back of the seat. The backrest is connected at the bottom with a rod whose other end is hingedly connected to a fixed point located approximately at the hip joint of a patient seated in the chair. Upon rearward tilting of the tilting frame, the backrest is pulled towards the seat by this rod.

In this known construction the lateral accessibility is not optimal, nor is the seat tiltable relative to the substructure.

Further features that increase convenience are set forth in the subclaims.

One embodiment of the apparatus according to the invention will be further explained, by way of example, with reference to the accompanying drawings, in which.

Figure 1:
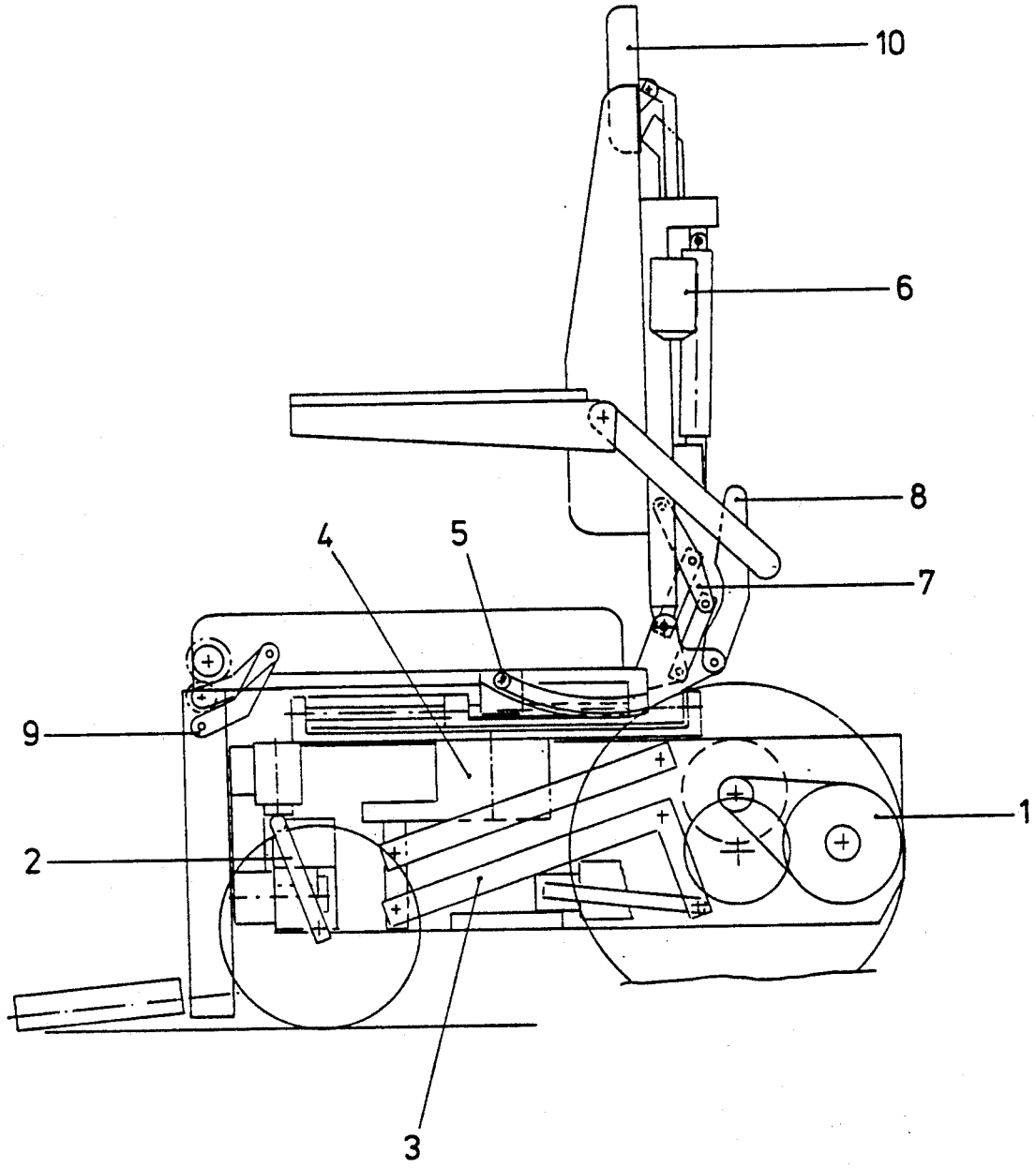
FIG. 1 is a diagrammatic view of a wheelchair equipped with different adjusting mechanisms for increasing convenience.

The wheelchair shown in FIG. 1 is built up from a plurality of separate units which can be mounted on a wheelchair in the form of modules to suit requirements. The wheelchair according to FIG. 1 is equipped with a drive unit 1, swivelling wheel suspension 2, a height-adjustment unit 3, a rotation unit 4 for rotating the wheelchair seat relative to the substructure, an adjustment mechanism 5 for changing the angle of posture, a tilting frame 6 for tilting the backrest, a rod mechanism 7 for moving the backrest relative to the tilting frame, an adjusting unit for the armrest 8, a leg hinging mechanism 9 and a movable head-rest 10. The various mechanisms and modules will be described in detail hereinafter.

I. The tilting frame 6

Figure 2:
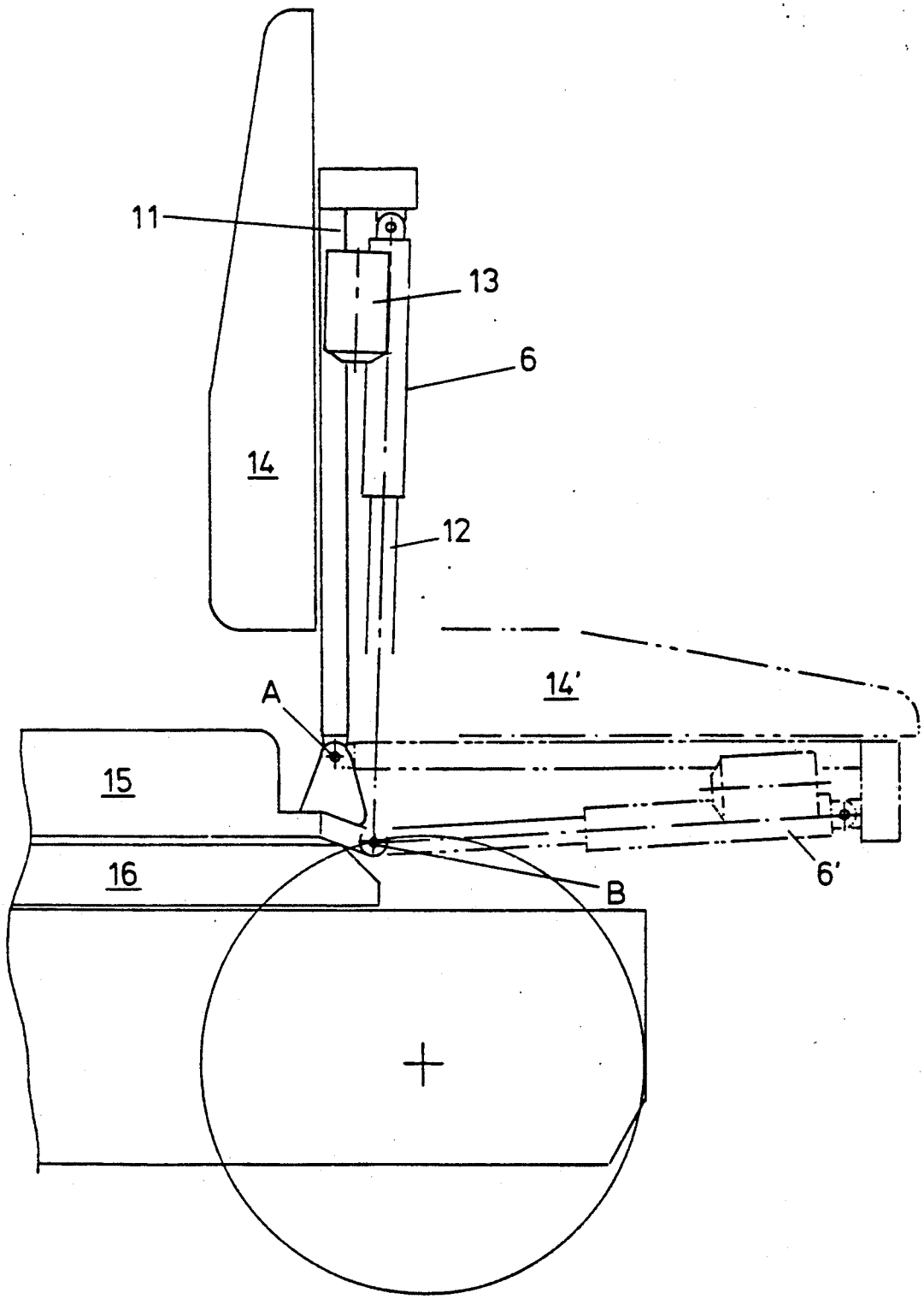
FIG. 2 is a diagrammatic view of the tilting frame for the backrest.

The tilting frame 6 shown in FIG. 2 consists of a reversed U-shaped construction with a fixed leg 11 and a length-adjustable leg 12. In a manner to be described hereinafter, the backrest 14 is connected to the fixed leg 11, which at the lower end A is hinged to a cheek of a supporting platform 16 which is supported in some manner or other, for example by the height-adjustment unit 3 shown in FIG. 1. Resting on the supporting platform 16 is a seat 15, the rear edge of which comprises a hinge point B, to which is connected the lower end of the length-adjustable leg 12. Mounted in the tilting frame 6 is an actuator 13 which may be of electric or hydraulic design and which is adapted to extend or shorten the leg 12 telescopically. At the top, the leg 12 is also hingedly connected to the connecting leg of the U-shaped construction.

Figure 3:
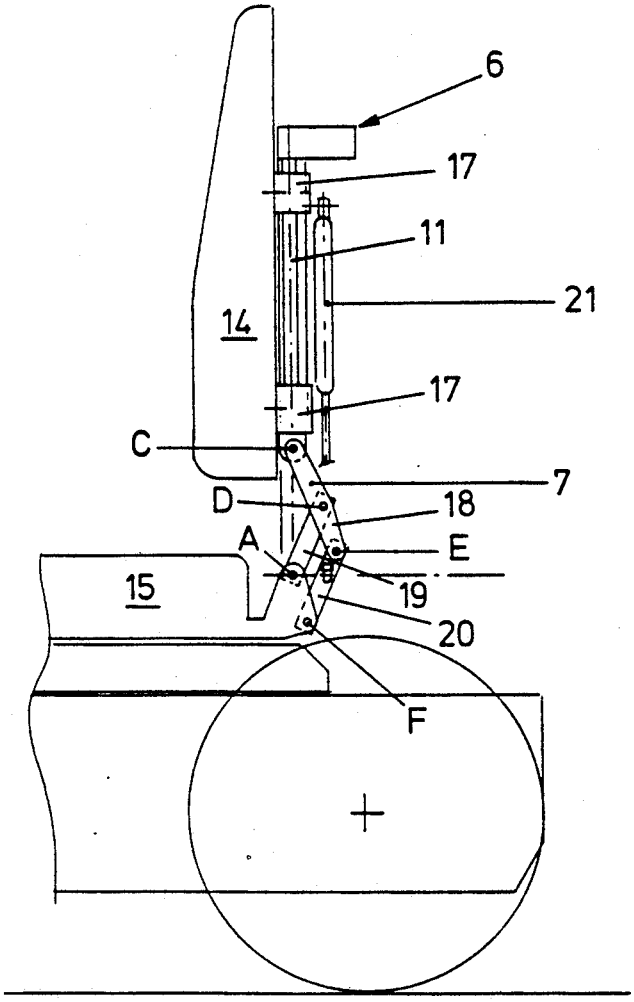
FIG. 3–4 show the rod mechanism for sliding the backrest relative to the tilting frame according to FIG. 2.

By shortening the leg 12 utilizing the actuator 13, the tilting frame, and hence the backrest connected thereto, will pivot about the hinge point A. In FIG. 2 the tilting frame 6 has tilted into the horizontal position 6', wherein the backrest 14 has been shifted relative to the tilting frame 6 by means of a rod mechanism 7 (see FIGS. 3–4).

The rod mechanism 7 substantially consists of a parallel mechanism A-D-E-F, point A thereof coinciding with the hinge point A shown in FIG. 2 and point F also being part of the seat 15. The legs 19 (AD) and 20 (FE) are of parallel extension. The fourth leg of the rod mechanism 7 is formed by the extended leg 18 which at point E is hingedly connected to the third leg 20 and has its other end C hingedly connected to backrest 14. At point D, the second leg 19 is hingedly connected to the extended leg 18.

The backrest 14 is slidably connected to the tilting frame 6 at 17.

Figure 4:
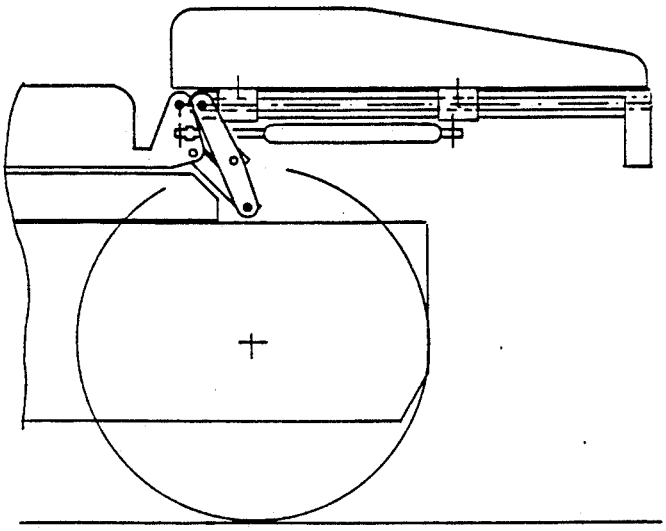

During pivoting of the tilting frame 6 about the hinge point A (FIG. 2), the hinge point D on the extended leg 18 traverses a circular arc about hinge point A. The third leg 20 remains invariably parallel to the second leg 19 and forces the hinge point C of the backrest 14 to move in the direction of the hinge point A. In the position as shown in FIG. 4 the tilting frame 6 has been tilted through 90°. By proper dimensioning of the rod mechanism 7, the displacement of the backrest in the direction of the hinge point A can be selected such that the backrest 14 remains in position relative to the back of the person sitting on the seat 15, in other words, the backrest 14 is pivoted about the hip joint of the person in question. To support the movement of backrest 14 relative to the tilting frame 6 a gas spring 21 may be provided which supports the movement of the backrest in one direction or in the other and thereby reduces the forces acting on the rod mechanism 7.

II. Adjusting mechanism for the angle of posture

Figure 5:
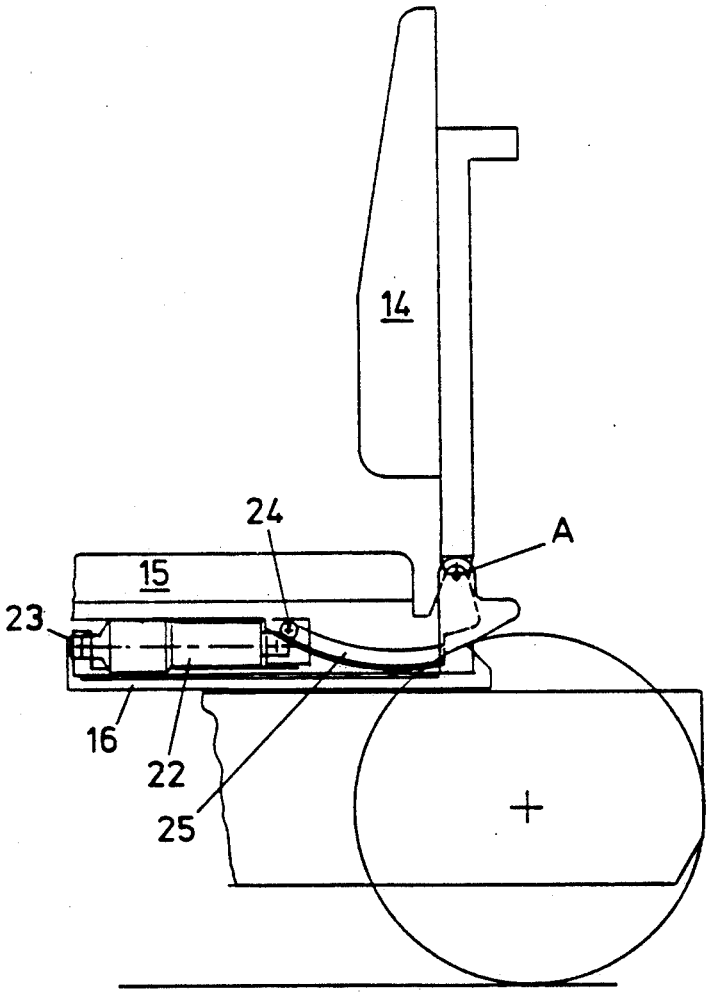
FIGS. 5–6 show the adjusting mechanism for adjusting the angle of posture.
Figure 6:
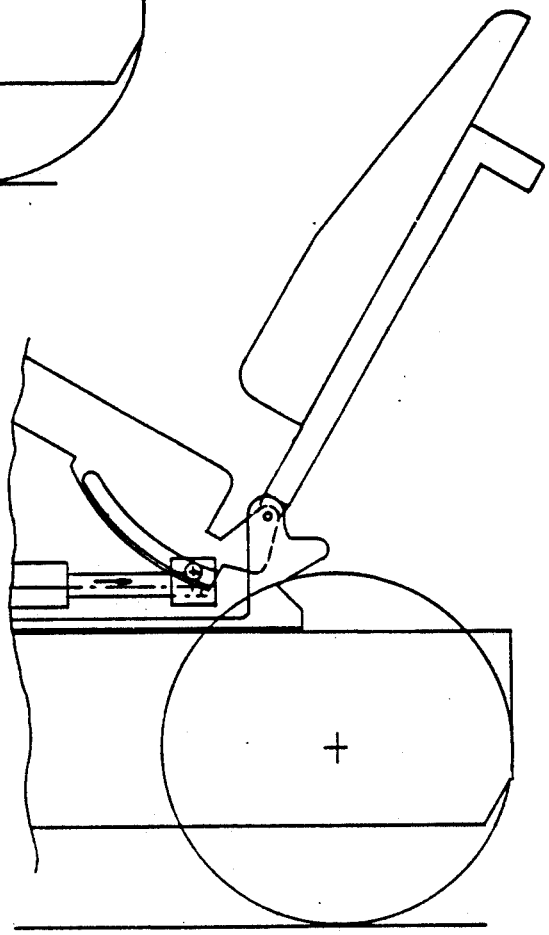

In addition to tilting the backrest, as explained hereinabove, it may be desirable to provide the wheelchair with a mechanism for adjusting the angle of posture, whereby the backrest and the seat are tilted through the same angle. A mechanism suitable for this purpose is shown in FIGS. 5–6.

Mounted in the supporting platform 16 is an actuator 22, whose fixed point 23 is connected to the supporting platform 16 and whose movable end is provided with a roller. This roller is mounted in a curved track 25 mounted at the bottom of the seat 15. By operating the actuator 22, the roller 24 will be moved towards the left, thereby causing the seat to tilt clockwise as a result of the shape of the curved track 25, as shown in FIG. 6. The center of curvature of the curved track is located above the seat 15. The seat tilts about the hinge point A. Since the adjustable leg 12 of the tilting frame has its lower end connected to the seat 15 (point B in FIG. 2), when the seat 15 is being tilted, the backrest is moved along with it and pivoted through the same angle. The shape of the curved track 25 must be chosen such that the hinge point B of the tilting frame 6 can traverse a circular path relative to the hinge point A, because otherwise the actuator 13 of the tilting frame would have to be controlled simultaneously with and in dependency on the actuator 22 for adjustment of the angle of posture.

III. Adjustment of the leg support

Figure 7:
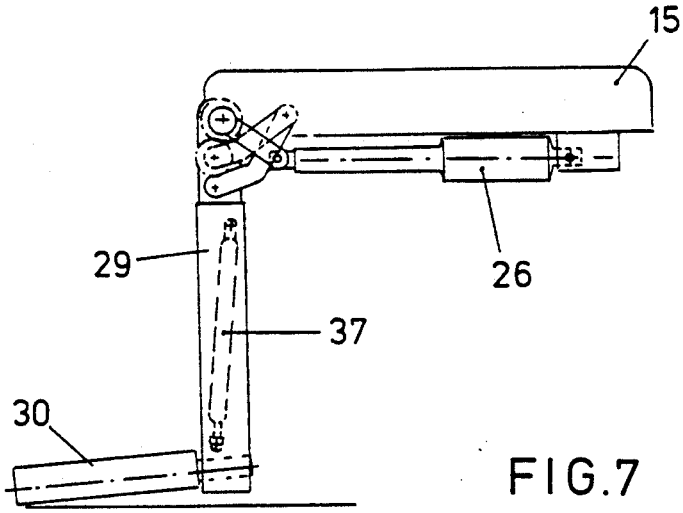
FIGS. 7–9 show the adjusting mechanism for adjusting the leg support.
Figure 8:
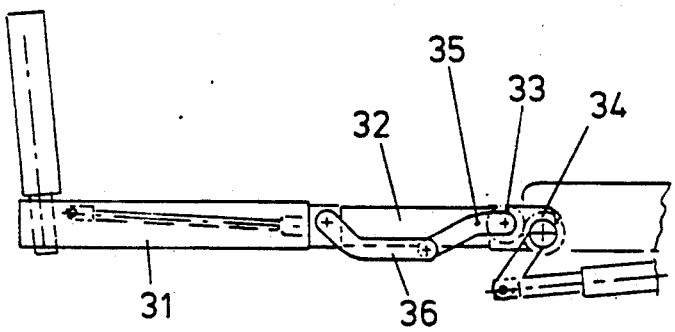
Figure 9:
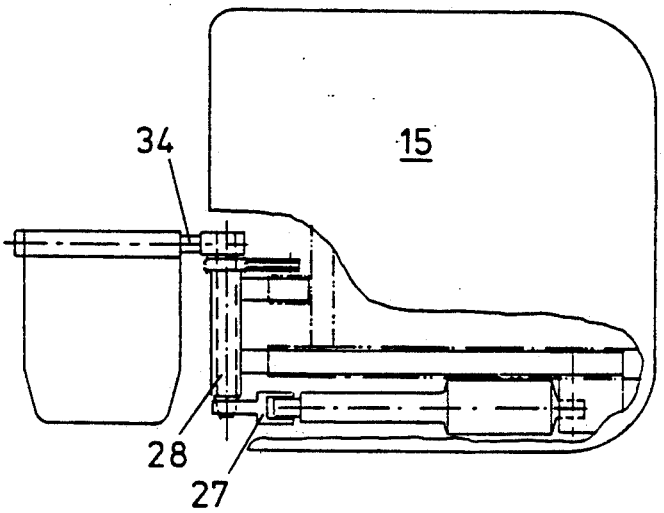

FIGS. 7–9 show the leg support adjusting mechanism. With it the same object is contemplated as in the adjustment of the back support 14, namely displacing the leg support in such a manner that it remains in the same position relative to the knee joint when the leg support is being pivoted.

The wheelchair according to the invention comprises a leg support adjusting mechanism for each leg. FIGS. 7–9 only show the adjusting mechanism for the left leg.

The leg support 29, provided at the lower end with a foot plate 30 is suspended from a horizontal shaft mounted under the front edge of the seat 15. At one end of the shaft 28 a crank-shaped fork 27 is arranged which is hingedly connected to the movable end of the actuator 26 also mounted under the seat 15. By shifting the movable end of the actuator in FIG. 7 to the left, the fork 27 is rotated about the axis of the shaft 28 and the leg support 29 is pivoted counterclockwise. The leg support 29 consists of an inner tube 32 which is fixedly connected to the horizontal shaft 28 and an outer tube 31 that can be shifted relative to the inner tube. Mounted around the shaft 28 is a fixed, non-rotatable gear wheel 34. The inner tube 32 is provided with a gear wheel 33 which is in mesh with this fixed gear wheel 34. The gear wheel 33 is restrained from rotation and connected to a first link 35 hingedly connected to a second link 36 whose end is hingedly connected to the edge of the outer tube 31.

The adjusting mechanism for the leg support operates as follows:

Upon operation of the actuator, the fork 27 is pivoted counterclockwise relative to the axis of the shaft 28. Rotation of the shaft 28 results in the inner tube 32 of the leg support 29 being pivoted counterclockwise. The gear wheel 33 then rolls over the fixed gear wheel 34, as a result of which the first link 35, connected to the gear wheel 33, is likewise pivoted counterclockwise. The result of this is that the second link 36 hingedly connected to the first link 35 is moved in the direction of the leg support 29, whereby the outer tube 31 is forced to shift relative to the inner tube 32. FIG. 8 shows the maximum pivotal displacement of the leg support 29. By an appropriate choice of the links 35, 36 and the angular displacement of the gear wheel 33, the outward displacement of the outer tube 31 can be selected such that the outer tube retains its position relative to the calf of the leg supported by it.

To relieve the adjusting mechanism, a gas spring 37 may be mounted in the leg support 29, which spring supports the shifting movement of the leg support 29 in one or the other direction.

IV. Construction of the armrest

Figure 10:
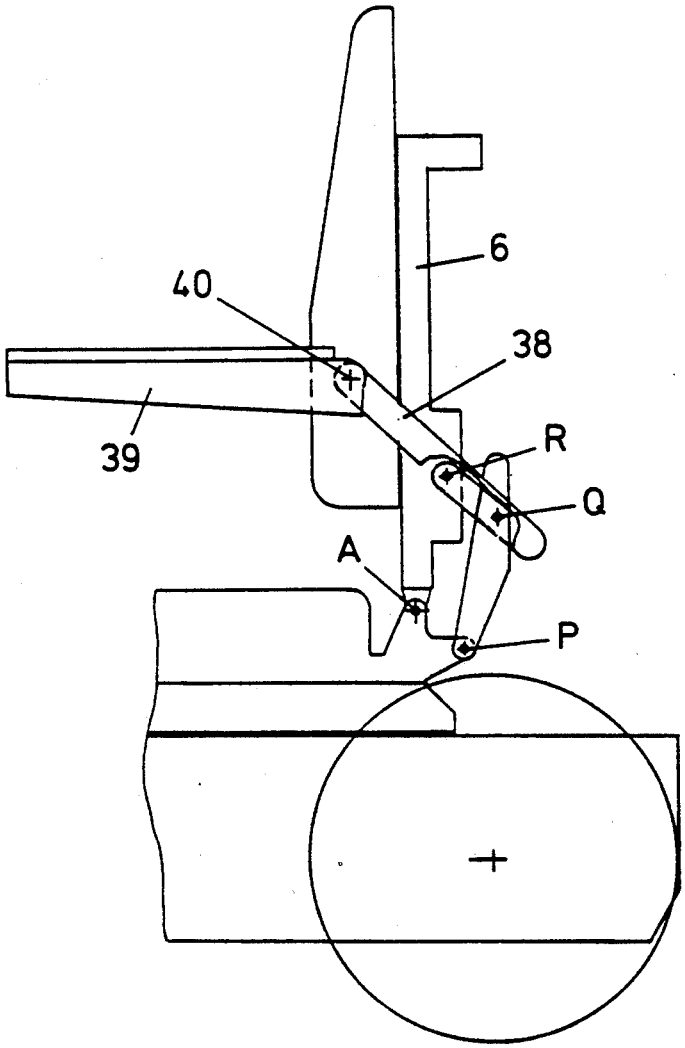
FIGS. 10–11 show the adjusting mechanism for the armrest.
Figure 11:
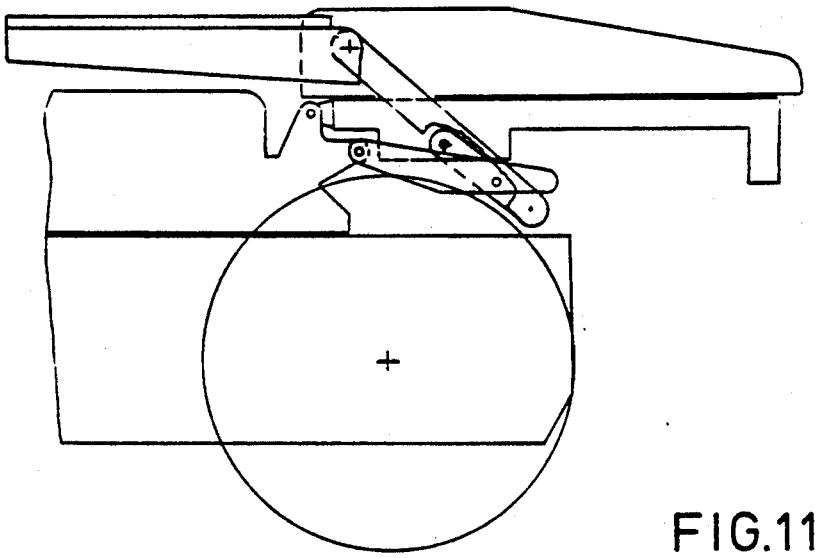

FIGS. 10 and 11 show the construction of the armrest 39 which is so designed that when the backrest is pivoted, the armrest remains horizontal. The mechanism used for that purpose is also a rod parallelogram A-R-Q-P, wherein the rod AP is part of the "fixed environment". At R the rod RQ is connected to the tilting frame 6 and at Q to the link PQ. At 40 the armrest is connected to a supporting tube 38.

When tilting frame 6 is pivoted, the rod RQ is displaced in parallel relationship to itself. The supporting tube 38, which is fixedly coupled to the rod RQ, also moves parallel to itself, so that the armrest continues to take up a fixed horizontal position relative to the supporting tube 38. In FIG. 11 the backrest has been pivoted into the horizontal position and the armrest 39 has reached its lowest position.

I claim:

1. A biomechanical body support comprising a substructure, a seat which is supported by said substructure and is tiltable relative to said substructure by a first tilt means, a backrest which is coupled to said seat and is tiltable relative to said seat by a second tilt means, a tilting axis of the second tilt means approximately coinciding with the pivotal point of the hip joint of a person resting on said seat, a leg support also tiltably connected to said seat by a third tilt means, characterized in that the backrest (14) is slideably mounted on a reverse U-shaped tilting frame (6) arranged behind the backrest by a slide means, a fixed leg of said frame, which is directed towards the backrest, being hingedly connected to a first pivot (A) of the seat by a hinge means (15) while a second leg of said frame (12) having length-adjustable means connected to a second pivot (B) of the seat, the backrest (14) being connected to the seat (15) by adjusting mechanism means for sliding the backrest (14) relative to the tilting frame (6) in the direction of the seat (15) upon downward pivoting movement of the tilting frame (6).

2. Apparatus according to claim 1, characterized in that the adjusting mechanism means (7) for connecting the backrest (14) to the seat (15) consists of a rod parallelogram (A-D-E-F) of which one leg (18) is extended and hingedly connected (at C) to the backrest (14), a second leg (19) extends between the hinge point (A) of the tilting frame (6) and approximately the center (D) of the extended leg (18), the third leg (20) is hingedly connected to the end (E) of the extended leg (18) and a third hinge point (F), which is part of the seat (15).

3. An apparatus according to claim 2, characterized in that the leg support (29) consists of two separate leg supports, which are pivotable relative to the seat (15) by the third tilt means (9).

4. An apparatus according to claim 3, characterized in that the inner tube (32) is provided at the top end with a gear wheel (33), which is restrained from rotation and connected to a first link (35), while the outer tube is provided with a second link hingedly connected to the outer tube and to the free end of the first link (35), the gear wheel (33) being in mesh with a fixed, non-rotatable gear (34) which is part of the seat (15).

5. Apparatus according to any one of claims 1–2, characterized in that the seat consists of a supporting platform (16) fixedly connected to the substructure and a seat proper (15) pivotable relative thereto by the first tilt means.

6. An apparatus according to claim 6, characterized in that the first tilt means (5) consists of one actuator (22) mounted on the supporting platform (16), which actuator comprises a roller (24) at its movable end, said roller (24) being locked in a curved track (25) mounted under the seat (15) and fixedly connected thereto, the center of curvature of said track being located above the seat.

7. An apparatus according to claim 5, characterized in that the leg support (29) consists of two separate leg supports, which are pivotable relative to the seat (15) by the third tilt means (9).

8. An apparatus according to claim 7, characterized in that the inner tube (32) is provided at the top end with a gear wheel (33), which is restrained from rotation and connected to a first link (35), while the outer tube is provided with a second link hingedly connected to the outer tube and to the free end of the first link (35), the gear wheel (33) being in mesh with a fixed, non-rotatable gear (34) which is part of the seat (15).

9. An apparatus according to claim 1, characterized in that the leg support (29) consists of two separate leg supports, which are pivotable relative to the seat (15) by the third tilt means (9).

10. An apparatus according to claim 9, characterized in that each leg support (29) comprises an inner tube (32) fixedly connected to the seat and an outer tube (31) slidable relative to said inner tube (32), the third tilt means causing the outer tube (31) to move relative to the inner tube (32) away from the seat when the leg support (29) is pivoted from the vertical position.

11. An apparatus according to claim 10, characterized in that the inner tube (32) is provided at the top end with a gear wheel (33), which is restrained from rotation and connected to a first link (35), while the outer tube is provided with a second link hingedly connected to the outer tube and to the free end of the first link (35), the gear wheel (33) being in mesh with a fixed, non-rotatable gear (34) which is part of the seat (15).

12. An apparatus according to claim 10, characterized in that the inner tube (32) is connected to one end of a horizontal rod mounted at the front edge of the seat (15), the other end of said rod supporting a crank-shaped fork (27) which is hingedly connected to the movable end of an actuator (26).

13. An apparatus according to claim 12, characterized in that the inner tube (32) is provided at the top end with a gear wheel (33), which is restrained from rotation and connected to a first link (35), while the outer tube is provided with a second link hingedly connected to the outer tube and to the free end of the first link (35), the gear wheel (33) being in mesh with a fixed, non-rotatable gear (34) which is part of the seat (15).

14. An apparatus according to claim 9, characterized in that the inner tube (32) is connected to one end of a horizontal rod mounted at the front edge of the seat (15), the other end of said rod supporting a crank-shaped fork (27) which is hingedly connected to the movable end of an actuator (26).

15. An apparatus according to claim 14, characterized in that the inner tube (32) is provided at the top end with a gear wheel (33), which is restrained from rotation and connected to a first link (35), while the outer tube is provided with a second link hingedly connected to the outer tube and to the free end of the first link (35), the gear wheel (33) being in mesh with a fixed, non-rotatable gear (34) which is part of the seat (15).

16. An apparatus according to claim 9, characterized in that the inner tube (32) is provided at the top end with a gear wheel (33), which is restrained from rotation and connected to a first link (35), while the outer tube is provided with a second link hingedly connected to the outer tube and to the free end of the first link (35), the gear wheel (33) being in mesh with a fixed, non-rotatable gear (34) which is part of the seat (15).

* * * * *